United States Patent [19]

Bologa

[11] 4,271,878

[45] Jun. 9, 1981

[54] LIQUID TRANSFER DEVICE

[76] Inventor: Elvis Bologa, 146 Kennard Ave., Downsview, Canada, M3H 4M5

[21] Appl. No.: 847,378

[22] Filed: Oct. 31, 1977

[51] Int. Cl.[2] ..... B65B 3/06; B67C 9/00

[52] U.S. Cl. ..... 141/375; 211/74; 248/146

[58] Field of Search ..... 141/364, 392, 319, 332, 141/340, 375, 98, 363, 367, 369-381; 248/311.3, 314, 146, 94, 56, 163; 211/74; 24/216, 217 R, 30.5 S, 255 BS

[56] References Cited

U.S. PATENT DOCUMENTS

| | | | |
|---|---|---|---|
| 808,824 | 1/1906 | Eick | 248/311.3 |
| 2,729,080 | 1/1956 | Bennett | 248/314 |
| 2,767,744 | 10/1956 | Beerman | 141/364 |
| 3,230,486 | 1/1966 | Worley | 141/375 |
| 3,381,825 | 5/1968 | Bessett | 211/74 |
| 3,516,111 | 6/1970 | Heyman | 248/314 |
| 3,603,551 | 9/1971 | Peterson | 248/314 |

*Primary Examiner*—Houston S. Bell, Jr.
*Attorney, Agent, or Firm*—Rogers, Bereskin & Parr

[57] ABSTRACT

A device for use in draining ketchup and the like from a bottle is described. The device includes an upper portion having an opening for receiving the neck of a bottle with the bottle in an inverted position. Means are provided for supporting the device in stable equilibrium on a support surface with the upper portion of the device in an elevated position in which the bottle is held clear of the support surface so that a container can be placed below the mouth of the bottle. A plurality of fingers extend inwardly of the opening in the upper portion of the device and are arranged to engage the neck of the bottle. The fingers are resiliently flexible so that they can be deflected outwardly by the bottle, whereby the fingers exert an inward biassing effect against the neck of the bottle and are capable of accommodating bottles of varying sizes.

3 Claims, 3 Drawing Figures

LIQUID TRANSFER DEVICE

This invention relates to a device for use in draining ketchup and the like from a bottle into a container.

Various devices have previously been proposed for this purpose. One type of prior art device is in the form of a sleeve which can be used to couple two bottles together with their necks in communication with one another. The bottle to be drained is inverted above the other bottle so that ketchup drains from the upper bottle to the lower. Coupling devices of this type are shown in the U.S. Pat Nos. 3,266,533 and 3,620,267. Such coupling devices have a number of disadvantages. First, it is necessary to make provision for escape of air from the bottle being filled in order to obtain effective drainage. Second, both bottles are out of use during the draining operation. Further, a coupling device cannot be used for draining into a container such as a dish or condiment dispenser.

U.S. Pat. No. 2,767,744 describes a liquid transfer device which includes a funnel for supporting a bottle to be drained and which is itself supported by an elongated, hollow, tubular member arranged to stand on a lower bottle intended to receive drained liquid. A given liquid transfer device of this type would accommodate and provide positive support for only one size of bottle.

U.S. Pat. No. 3,230,986 discloses a bottle draining rack which includes two rings for supporting a bottle to be drained in an inverted position above a lower bottle and a funnel for guiding ketchup and the like from the upper bottle into the lower bottle. A problem with this type of device is that it does not provide stable support for bottles of diameters smaller than the top ring nor for bottles with neck lengths shorter than the distance between the two support rings.

An object of the present invention is to provide a device for use in draining ketchup and the like from a bottle which device is capable of providing positive support for bottles of varying sizes.

According to the invention, the device includes an upper portion having an opening for receiving the neck of a bottle with the bottle in an inverted position. Means are provided for supporting the device in stable equilibrium on a support surface with the upper portion of the device in an elevated position in which the bottle is held clear of the support surface so that a container can be placed below the mouth of the bottle. A plurality of fingers extend inwardly of the opening in the upper portion of the device and are arranged to engage the neck of the bottle. The fingers are resiliently flexible so that they can be deflected outwardly by the bottle, whereby the fingers exert an inward biassing effect against the neck of the bottle and are capable of accommodating bottles of varying sizes.

In order that the invention may be more clearly understood, reference will be made to the accompanying drawings which illustrate a preferred embodiment of the invention by way of example. In the drawings.

Figure 1:
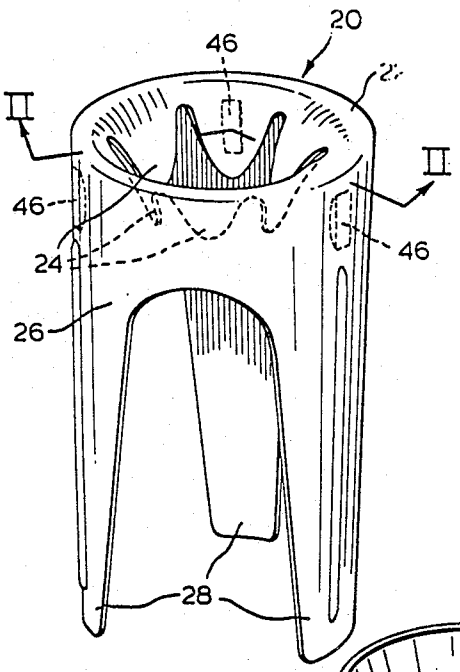
FIG. 1 is a perspective view of a device according to the invention.

Referring to FIG. 1, the device is in the form of a one-piece plastic moulding 20 which includes an upper portion 22 of annular shape having an opening for receiving the neck of an inverted ketchup bottle. Dependent downwardly and inwardly from the upper portion 22 are six resiliently flexible bottle supporting fingers 24, each of which is of rounded triangular shape. A generally cylindrical skirt portion 26 extends downwardly around the outer periphery of portion 22 and three legs 28 in turn depend from portion 26. The legs are equally spaced around portion 26 and support the device in stable equilibrium clear of a support surface. Each leg is of an arcuate cross-sectional shape corresponding generally to the curvature of skirt portion.

Figure 2:
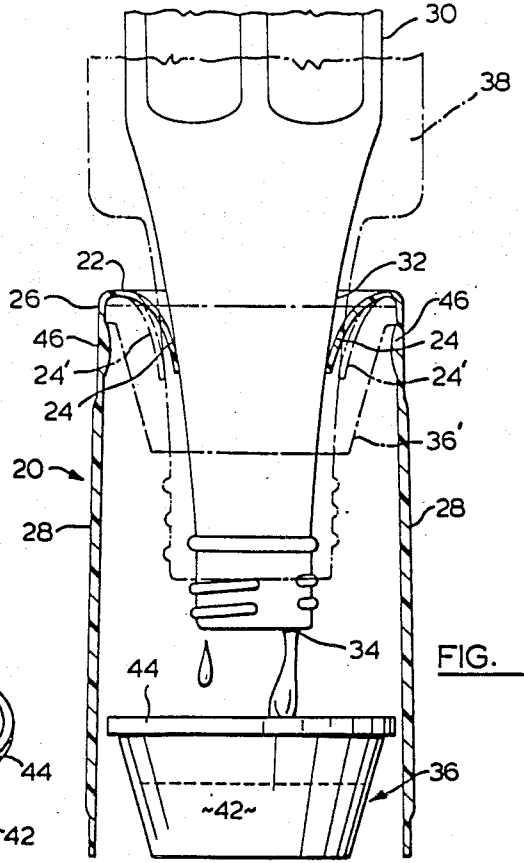
FIG. 2 is a sectional view on line II—II of FIG. 1 showing the device in use in association with a ketchup bottle and a dish for receiving drained ketchup; and, FIG. 3 is a perspective view of the dish which is shown in FIG. 2.

FIG. 2 shows the device of FIG. 1 in use for draining ketchup from a bottle 30 having a relatively narrow neck 32 and a mouth 34. A dish 36 is shown in position below the mouth 34 for receiving ketchup drained from bottle 30. It will be noted that the bottle is disposed in an inverted position in the opening in the upper portion 22 of the device and that the fingers 24 make surface contact with the neck 32 of the bottle and support the latter in the inverted position in which it is shown. The weight of the bottle and contents cause the flexible supporting fingers to be deflected outwardly and stressed so that the fingers exert an inward biassing effect against the bottle. Accordingly, the fingers in effect grip and positively support the bottle 30 in its inverted position in the device. It will be noted that the depth of penetration of the bottle into the upper portion of the device can be varied according to the gripping effect reguired to support a particular bottle.

FIG. 2 also illustrates how the device 20 can be used for draining bottles of varying sizes. Thus, a relatively large necked bottle is shown in ghost outline at 38 in position in the device 20. The position of the fingers 24 for supporting bottle 38 are also shown in ghost outline at 24'. It will be noted that the fingers are deflected outwardly further than with the narrower necked bottle 30 and are therefore stressed to a greater extent; accordingly, the wider necked bottle is gripped more tightly than bottle 28.

Figure 3:
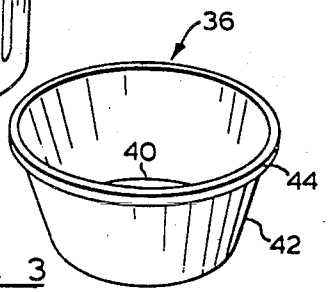

FIG. 3 shows the dish 36 separate from device 20. The dish 36 has a round, flat bottom 40 and a side-wall 42 which extends upwardly and slightly outwardly from the bottom 40 to a rim 44. The circumference of the dish 36 at rim 44 is slightly less than the inner circumference of the skirt portion 26 of the device so that dish 36 can be disposed in a storage position immediately below the annular upper portion 22 of the device as indicated in ghost outline at 36' in FIG. 2. Three equally spaced retaining elements 46 (FIGS. 1 and 2) project inwardly of the skirt portion at positions spaced downwardly from the upper portion 22 of the device such that the rim 44 of dish 36 can be engaged over the elements to retain the dish in its storage position. When the device is to be used, the dish 36 is simply displaced downwardly to cause rim 44 to disengage from the retaining elements 46. The dish can then be positioned below the mouth of the bottle to be drained as described previously. The retaining elements 46 are integrally moulded with the skirt portion 26 of the device 20 as shown in FIG. 2.

It will, of course, be appreciated that the preceding description relates to a specific embodiment and that many modifications are possible within the broad scope of the invention. For example, in the preferred embodiment, the upper portion, flexible supporting fingers and support legs are shown as a moulded unit. This is not essential; the flexible supporting fingers and support legs could be independent parts attached by any convenient means to the upper portion. The upper portion is shown to be round but could be any convenient shape. For example, the upper portion could be rectangular and formed with an opening for receiving a ketchup bottle. The flexible supporting fingers are shown to be of a rounded, triangular shape, although this is not essential. Also, although the fingers are shown to be downwardly dependent from the upper portion of the device, they could project radially inwardly or upwardly of the opening in said portion. The device shown in the drawings includes legs 28 for supporting the upper portion of the device. However, support means of other forms may be used. For example, the upper portion of the device could be supported by a hollow cylinder made of a transparent material. Where support legs are used, it is to be understood that the legs may be two or more in number and that the legs may be adjustable to accommodate different sized receptacles below the mouth of an inverted bottle. FIGS. 2 and 3 illustrate a convenient dish assembly which is used in association with the device. However, any convenient receptacle such as a jar, condiment dispenser or other bottle can be placed below the outlet of the inverted bottle to collect the drained ketchup.

As indicated above, the device may be moulded in a plastic material; for example, an injection moulding technique may be used. Any suitable material may be used such as PVC or ABS plastic. The device may be transparent or may be coloured. Alternatively, the device may be constructed of a suitable metal such as aluminum or tin or with a combination of a metal and a plastic.

Although the device has been illustrated and described in association with draining ketchup from a bottle, it will be appreciated that the device can be used for draining other liquids or semi-liquids from bottles, such as, for example, salad dressing, steak sauce, barbeque sauce and chili sauce.

What I claim is:

1. The combination of: a device for use in draining ketchup and the like from a bottle having a neck defining a mouth; and a receptacle for receiving ketchup and the like drained from said bottle, wherein the receptacle comprises a flat bottom wall, a side-wall extending upwardly from said bottom wall to a top edge, and an externally projecting annular rim which extends around said top edge;

and wherein the device comprises:

an upper portion of annular shape having an opening for receiving the neck of the bottle with the bottle in an inverted position;

a generally cylindrical skirt portion extending downwardly from the outer periphery of said upper portion, a plurality of support legs depending from said skirt portion in spaced positions and arranged to support the device in stable equilibrium on a support surface with said upper portion of the device in an elevated position in which the bottle is held clear of the support surface so that said receptacle can be placed below the mouth of the bottle for receiving drained ketchup and the like;

a plurality of fingers each having an inner end portion coupled to said upper portion of the device and a free outer end portion, the fingers extending inwardly of the opening in said upper portion and being curved downwardly for engagement with the neck of said bottle, said fingers being resiliently flexible so that they can be deflected outwardly by the bottle, whereby the fingers exert an inward biassing effect against the neck of the bottle, and are capable of accommodating bottles of varying sizes;

and wherein said skirt portion of the device is dimensioned so that said receptacle can be lifted into a storage position when the device is not in use, with said annular rim of the receptacle nested inside said skirt portion immediately below said upper portion, said skirt portion including a plurality of retaining elements projecting inwardly of said skirt portion of the device for engagement below said rim of the receptacle and arranged so that said annular rim of the receptacle can be forced over said retaining elements in bringing the receptacle into and from its storage position.

2. A device as claimed in claim 1, wherein the said fingers are of a rounded triangular shape.

3. A device as claimed in claim 1, in the form of a one-piece plastic moulding.

* * * * *